US010471706B2

(12) United States Patent
Sakai et al.

(10) Patent No.: US 10,471,706 B2
(45) Date of Patent: Nov. 12, 2019

(54) INK JET RECORDING METHOD AND INK JET RECORDING APPARATUS

(71) Applicant: CANON KABUSHIKI KAISHA, Tokyo (JP)

(72) Inventors: Junichi Sakai, Machida (JP); Takashi Imai, Kawasaki (JP); Shinichi Sakurada, Gainesville, FL (US); Shota Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/033,472

(22) Filed: Jul. 12, 2018

(65) Prior Publication Data

US 2019/0016117 A1 Jan. 17, 2019

(30) Foreign Application Priority Data

Jul. 14, 2017 (JP) ..... 2017-138192
Jun. 14, 2018 (JP) ..... 2018-113663

(51) Int. Cl.

| | |
|---|---|
| ***B41J 2/005*** | (2006.01) |
| ***B41M 5/00*** | (2006.01) |
| ***B41J 2/01*** | (2006.01) |
| ***B41M 5/025*** | (2006.01) |
| *B41M 7/00* | (2006.01) |

(52) U.S. Cl.

CPC ..... *B41J 2/0057* (2013.01); *B41J 2/01* (2013.01); *B41M 5/0017* (2013.01); *B41M 5/0256* (2013.01); *B41J 2002/012* (2013.01); *B41M 5/0011* (2013.01); *B41M 7/00* (2013.01)

(58) Field of Classification Search

CPC ..... B41J 2/0057; B41J 29/17; B41J 11/007; B41M 7/0018
USPC ..... 347/21, 100, 103
See application file for complete search history.

(56) References Cited

U.S. PATENT DOCUMENTS

| | | | | |
|---|---|---|---|---|
| 6,935,732 | B2 | 8/2005 | Takada et al. | |
| 7,281,790 | B2 | 10/2007 | Mouri et al. | |
| 7,377,631 | B2 | 5/2008 | Takada et al. | |
| 8,362,108 | B2 | 1/2013 | Imai | |
| 9,090,789 | B2 * | 7/2015 | Hakamada | C09D 11/322 |
| 9,783,694 | B2 | 10/2017 | Tominaga et al. | |
| 9,802,412 | B2 | 10/2017 | Sakurada | |
| 10,017,656 | B2 * | 7/2018 | Torisaka | C09D 11/54 |

(Continued)

FOREIGN PATENT DOCUMENTS

JP 2005-170036 A 6/2005

*Primary Examiner* — An H Do
(74) *Attorney, Agent, or Firm* — Venable LLP

(57) ABSTRACT

There is provided an ink jet recording method which records an image on a recording medium using aqueous ink. The ink jet recording method includes an intermediate image forming step of forming an intermediate image by applying aqueous ink to a transfer body and then applying an aqueous transfer promotion liquid to a region of the transfer body in which the aqueous ink is applied; and a transferring step of transferring the intermediate image by bring the intermediate image into contact with the recording medium in this order. The transfer promotion liquid contains a rosin particle formed by containing a rosin ester resin, an anionic emulsifier and a nonionic emulsifier, and the content of an alkali metal ion in the transfer promotion liquid is more than that of an alkali metal ion in the ink.

12 Claims, 1 Drawing Sheet

(56) References Cited

U.S. PATENT DOCUMENTS

| | | | |
|---|---|---|---|
| 2017/0282533 | A1 | 10/2017 | Sakurada et al. |
| 2018/0093469 | A1 | 4/2018 | Sakurada et al. |

* cited by examiner

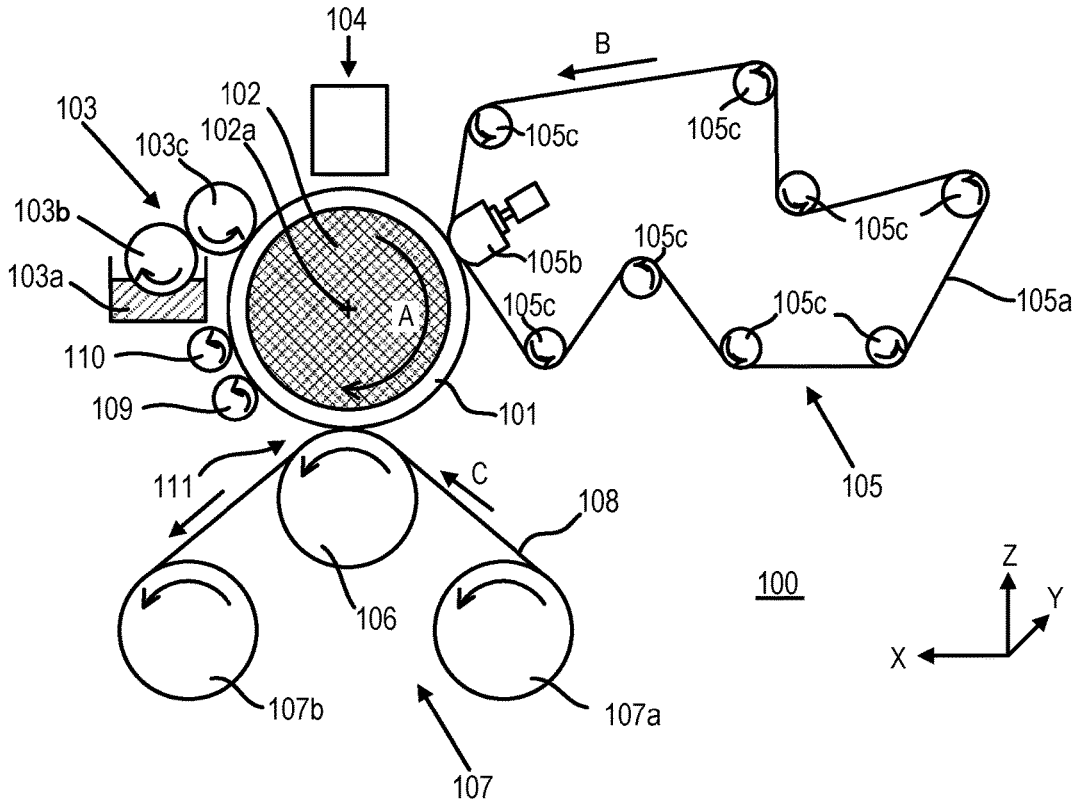
104
B
102
103
102a
103c
105c
105c
103b
105c
105c
105b
103a
A
105c
105c
105a
110
109
101
105
111
C
108
100
Z
Y
X
106
107b
107a
107

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

Ink jet recording method is useful as a method for directly recording an image on a recording medium into which ink easily penetrates. In recent years, applications of the ink jet recording method have been extended to a method for directly recording an image on recording mediums such as actual printing stock, into which ink hardly penetrate, among coated papers. In addition, the ink jet recording method has also been applied to a so-called transfer type recording method which transfers an intermediate image formed on an ink impermeable transfer body such as silicone rubber onto the recording medium.

To record a high-quality image on the recording medium by using the transfer type ink jet recording apparatus, it is required that the transferability of the intermediate image from the transfer body is good. For example, if a transfer defect in which a part of the intermediate image on the transfer body is not transferred or a transfer failure in which the intermediate image is separated inside thereof to be divided into the transfer body and the recording medium, respectively, and thus only a part of the image is transferred, occurs, the obtained image quality is lowered.

For example, Japanese Patent Application Laid-Open No. 2005-170036 in which an ink jet recording method for applying a liquid containing a water-soluble resin to a transfer body has been proposed (refer to Japanese Patent Application Laid-Open No. 2005-170036) discloses that if the liquid is applied to the transfer body prior to applying the ink, the peeling property of the image from the transfer body is improved or if the liquid is applied to the transfer body after applying the ink, the adhesion of the image to the recording medium is increased.

SUMMARY OF THE INVENTION

In order to stably record the high-quality image on the recording medium using the transfer type ink jet recording apparatus, it is important to improve the transferability to the recording medium. However, as a result of investigation by the present inventors, there is room for further improvement in transferability of the intermediate image even by the method and the like proposed in Japanese Patent Application Laid-Open No. 2005-170036. In addition, it was found that even if the liquid for promoting the transfer is adopted, depending on the composition of the liquid, the transferability can be improved, but the storage stability of the liquid is reduced.

An object of the present invention is to provide a transfer type ink jet recording method capable of making transferability of an intermediate image to a recording medium excellent, and stably recording a high-quality image on the recording medium. Another object of the present invention is to provide an ink jet recording apparatus used in the ink jet recording method.

The above object is accomplished by the present invention to be described below. That is, according to the present invention, there is provided an ink jet recording method for recording an image on a recording medium using aqueous ink, including: forming an intermediate image by applying the aqueous ink to a transfer body and then applying an aqueous transfer promotion liquid to a region to which the aqueous ink of the transfer body is applied; and transferring the intermediate image by bringing the intermediate image into contact with the recording medium in this order, wherein the transfer promotion liquid contains a rosin particle formed by containing a rosin ester resin, an anionic emulsifier and a nonionic emulsifier, and the content of an alkali metal ion in the transfer promotion liquid is more than the content of an alkali metal ion in the ink.

According to the present invention, it is possible to provide the transfer type ink jet recording method capable of making the transferability of the intermediate image to the recording medium excellent, and stably recording the high-quality image on the recording medium. In addition, according to the present invention, it is possible to provide the ink jet recording apparatus used in the ink jet recording method.

Further features of the present invention will become apparent from the following description of exemplary embodiments with reference to the attached drawing.

BRIEF DESCRIPTION OF THE DRAWINGS

FIGURE is a schematic diagram showing an ink jet recording apparatus according to an embodiment of the present invention.

DESCRIPTION OF THE EMBODIMENTS

Preferred embodiments of the present invention will now be described in detail in accordance with the accompanying drawing.

Hereinafter, the present invention will be described in more detail with reference to preferred embodiments. In the present invention, when a compound is salt, although the salt in ink remains dissociated in ions, for convenience sake, the salt in ink is expressed by "containing salt". In addition, the aqueous ink and the aqueous transfer promotion liquid for the ink jet may be simply referred to as "ink" and "transfer promotion liquid". Unless otherwise specified, the physical property values are values at normal temperature (25° C.), normal humidity (50% RH) and atmospheric pressure (1 atm). "(Meth)acrylic acid" and "(meth)acrylate" each means "acrylic acid and methacrylic acid" and "acrylate and methacrylate".

The present inventors have studied a recording method using a liquid proposed in Japanese Patent Application Laid-Open No. 2005-170036. As a result, the aggregation of the intermediate image formed on the transfer body is not progressed, so that the transferability is insufficient. Therefore, in order to improve the transferability by increasing the adhesiveness of the intermediate image to the recording medium, it is necessary to use a particle formed of the rosin ester resin which is known as the tackifier. That is, it has been found that the transferability can be improved by forming the intermediate image by applying the ink to the transfer body and then applying the transfer promotion liquid containing the rosin ester resin and transferring the intermediate image onto the recording medium. However, it was also found that depending on the composition of the transfer promotion liquid, the transferability can be improved, but the storage stability of the transfer promotion liquid was lowered.

The present inventors have done additional researches focusing on the configuration of the particle formed of the rosin ester resin contained in the transfer promotion liquid and the relationship between the transfer promotion liquid and the ink. As a result, it was found that the rosin particle formed by including the rosin ester resin, the anionic emulsifier and the nonionic emulsifier may be used as the resin particle to be contained in the transfer promotion liquid. In addition to this, it is possible to improve the transferability while satisfying the storage stability of the transfer promotion liquid, by satisfying the relationship that the content of an alkali metal ion in the transfer promotion liquid is more than the content of an alkali metal ion in the ink.

If the ink is applied to the surface of the transfer body on which the intermediate image is formed, the components in the ink begin to aggregate due to the evaporation of the liquid component such as water. The ink adhering to the transfer body (hereinafter may be referred to as "ink layer") tends to be aggregated because as the content of the alkali metal ion which is an electrolyte is increased, the hydration water is deprived or the electric double layer is compressed. If the transfer promotion liquid is applied to the ink layer to overlap with the ink layer so as to form the intermediate image configured of the ink layer and the transfer promotion liquid layer, the following phenomenon occurs. Since the content of the alkali metal ion in the transfer promotion liquid is more than that of the ink, the alkali metal ion and the ink are mixed at the interface where the ink layer and the transfer promotion liquid come into contact with each other, so that the ink is further aggregated. By doing so, the adhesion between the ink layer and the transfer promotion liquid layer increased. Then, it is considered that the transferability can be increased because it is difficult to separate the ink layer from the transfer promotion liquid layer when the intermediate image is transferred onto the recording medium.

Considering the above mechanism, it is also considered that it is sufficient to form the ink layer in which a large amount of alkali metal ion is present originally, rather than adjusting the relationship between the contents of the alkali metal ion. However, even if the method is used, the transferability cannot be improved for the following reasons. First, if the concentration of the alkali metal ion in the ink is increased to the extent in which the adhesion is increased, rather than adjusting the relationship of the content, there is a possibility that the reliability of the ink for the ink jet may be damaged. In addition, even if the content of the alkali metal ion in the ink is increased to a certain extent in which the reliability is not damaged, the transferability becomes insufficient as well when the content of the alkali metal ion in the transfer promotion liquid subsequently applied to the ink is relatively small. In this case, the content of the alkali metal ion has a relationship of ink layer>transfer promotion liquid layer. Then, the alkali metal ion in the ink layer is diffused into the transfer promotion liquid layer and the aggregation of the ink layer is relieved, by the effect of equalizing the concentration gradient, so that the transferability may be insufficient.

The use of the resin particle formed by including the rosin ester resin, the anionic emulsifier and the nonionic emulsifier as the rosin particle to be contained in the transfer promotion liquid also contributes to the improvement in the transferability. This is because by using the rosin resin having the configuration, the rosin resin having the level at which the relationship between the contents of the alkali metal ion of the ink and the transfer promotion liquid can be satisfied can be stably contained in the transfer promotion liquid. The reason is presumed as follows.

The following effects are generated by allowing the anionic emulsifier and the nonionic emulsifier to coexist in the rosin ester resin as the component for forming the rosin particle. First, the dispersion stabilization of the rosin particle is promoted and the storage stability is maintained, by two repulsive forces such as the electrostatic repulsion due to the anionic group of the anionic emulsifier and the steric repulsion due to the nonionic emulsifier. Here, the dispersion stabilization due to the electrostatic repulsion of the anionic emulsifier is caused by the presence of the electric double layer, and although the electrostatic repulsion is a stronger action than the steric repulsion, the greater the concentration of the electrolyte in the system, the weaker the effect of the dispersion stabilization. In contrast, although the dispersion stabilization due to the steric repulsion of the nonionic emulsifier is a weaker action than the electrostatic repulsion, it is little affected by the electrolyte in the system. Therefore, even when the dispersion stabilization becomes insufficient in the case of using the anionic emulsifier alone, due to a large amount of the ion to a certain extent present in the system, more ions can be present in the transfer promotion liquid if the above two kinds of emulsifiers are used. That is, it is possible to improve the transferability while ensuring the storage stability of the transfer promotion liquid by allowing the anionic emulsifier and the nonionic emulsifier to coexist in the rosin ester resin.

<Ink Jet Recording Method and Ink Jet Recording Apparatus>

The ink jet recording method of the present invention (hereinafter, also simply referred to as "recording method") is a method for recording an image on a recording medium using aqueous ink. The recording method of the present invention includes: an intermediate image forming step of forming an intermediate image by applying aqueous ink to a transfer body and then applying a transfer promotion liquid to the transfer body; and a transferring step of transferring the intermediate image by bring the intermediate image into contact with the recording medium in this order. In the intermediate image forming step, the intermediate image is formed by applying the transfer promotion liquid to at least a part of a region in which the aqueous ink is applied to the transfer body. That is, the recording method of the present invention is a transfer type ink jet recording method. The recording method of the present invention may include, if necessary, a reaction liquid applying step of applying a reaction liquid to the transfer body, a liquid absorbing step of absorbing a liquid component from the intermediate image formed on the transfer body, a heating step of heating the intermediate image formed on the transfer body, a cleaning step of cleaning the transfer body after the transferring step and the like.

In addition, an ink jet recording apparatus of the present invention (hereinafter, also simply referred to as "recording apparatus") is an apparatus used for recording an image on a recording medium using aqueous ink. The recording apparatus of the present invention includes: an ink applying unit which ejects aqueous ink by an ink jet system and applies the aqueous ink to a transfer body; an intermediate image forming unit which applies a transfer promotion liquid to a region of the transfer body to which the aqueous ink is applied to form an intermediate image; and a transfer unit which transfers the intermediate image by bringing the intermediate image into contact with the recording medium. The intermediate image forming unit applies the transfer promotion liquid to at least a part of the region of the transfer body to which the aqueous ink is applied. That is, the recording apparatus of the present invention is a so-called transfer type ink jet recording apparatus. The recording apparatus of the present invention may include, if necessary, a reaction liquid applying unit which applies a reaction liquid to the transfer body, a liquid absorbing unit which absorbs a liquid component from the intermediate image formed on the transfer body, a heating unit which heats the intermediate image formed on the transfer body, a cleaning unit which cleans the transfer body after transfer and the like.

FIGURE is a schematic diagram showing an ink jet recording apparatus according to an embodiment of the present invention. A transfer type ink jet recording apparatus 100 shown in FIGURE is a sheet type ink jet recording apparatus which transfers an intermediate image onto a recording medium 108 via a transfer body 101 to produce recorded matters. An X direction, a Y direction and a Z direction respectively indicate a width direction (full length direction), a depth direction and a height direction of the transfer type ink jet recording apparatus 100. The recording medium is conveyed in the X direction.

A transfer type ink jet recording apparatus 100 includes a transfer body 101, a reaction liquid applying device 103, an ink and transfer promotion liquid applying device 104, a liquid absorbing device 105 and a pressing member 106. The transfer body 101 is supported on a support member 102. The reaction liquid applying device 103 is a device which applies a reaction liquid containing a reactant reacting with ink to the transfer body 101. The ink and transfer promotion liquid applying device 104 includes a recording head which applies ink to the transfer body 101 to which the reaction liquid is applied to form an intermediate image. The liquid absorbing device 105 is a device which absorbs a liquid component from the intermediate image. The pressing member 106 is a member which transfers the intermediate image, from which the liquid component is removed, onto the sheet-like recording medium 108 such as paper. The transfer type ink jet recording apparatus 100 further includes a cleaning member for transfer body 109 which cleans a surface of the post-transfer transfer body 101. The transfer body 101, the reaction liquid applying device 103, the recording head of the ink and transfer promotion liquid applying device 104, the liquid absorbing device 105 and the cleaning member for transfer body 109 each have a length corresponding to the recording medium 108 used in the Y direction.

The transfer body 101 rotates in a direction of an arrow A about a rotating shaft 102*a* of the support member 102. The reaction liquid is applied from the reaction liquid applying device 103 to the rotating transfer body 101 and then the ink is applied from the ink and transfer promotion liquid applying device 104, so the intermediate image is formed on the transfer body 101. The intermediate image formed on the transfer body 101 moves up to a position where the intermediate image comes into contact with a liquid absorbing member 105*a* of the liquid absorbing device 105 by the rotation of the transfer body 101.

The liquid absorbing member 105*a* configuring the liquid absorbing device 105 moves (rotates) in a direction of an arrow B in synchronization with the rotation of the transfer body 101. The intermediate image formed on the transfer body 101 comes into contact with the moving liquid absorbing member 105*a*. In the interim, the liquid absorbing member 105*a* absorbs and removes the liquid component from the intermediate image. From the viewpoint of efficiently absorbing the liquid component from the intermediate image, the liquid absorbing member 105*a* is preferably pressed against the transfer body 101 with a predetermined pressing force. The intermediate image is formed of the reaction liquid used as necessary and the ink and transfer promotion liquid. Therefore, absorbing the liquid component from the intermediate image refers to absorbing the liquid component in the reaction liquid used as necessary and the ink and transfer promotion liquid. It can be also said that the liquid component from the intermediate image refers to concentrating the ink or the like. By concentrating the ink or the like, a ratio of a solid content of a coloring material, a resin or the like with respect to the liquid component increases.

The intermediate image in which the liquid component is removed and the ink is concentrated is moved to a transfer part 111 which comes into contact with the recording medium 108, which is conveyed by a recording medium conveying device 107, by the rotation of the transfer body 101. The intermediate image and the recording medium 108 come into contact with each other by being pressed from the pressing member 106 in the state in which the intermediate image and the recording medium 108 are sandwiched between the transfer body 101 and the pressing member 106. In the case of using the roller-like transfer body 101 and the columnar pressing member 106, the intermediate image and the recording medium 108 come into linear contact each other along the Y direction. If the transfer body 101 formed of an elastic material is used, since the transfer body 101 is depressed by pressing, the intermediate image and the recording medium 108 come into contact with each other on a surface. For this reason, a line or a surface where the intermediate image and the recording medium 108 are in contact is defined as a "region", and a part including this region is defined as the transfer part 111. While the intermediate image comes into contact with the recording medium 108, the pressing member 106 presses the transfer body 101 to transfer the intermediate image onto the recording medium 108, so the desired image is recorded on the recording medium 108. The post-transfer image is a reverse image of the pre-transfer intermediate image.

If the reaction liquid is applied to the transfer body using a roller-like reaction liquid applying member 103*c*, the reaction liquid is applied over the whole transfer body. Since the intermediate image is formed by applying the ink to the transfer body to which the reaction liquid is applied, the reaction liquid which does not react with the ink remains in the region in which the ink is not applied in the transfer body. The liquid absorbing member 105*a* can remove the liquid components from the unreacted reaction liquid as well as the intermediate image. The liquid component contained in the ink or the transfer promotion liquid is present in a substantially constant volume while having flowability but not having a fixed form. The liquid component contained in the ink or the transfer promotion liquid is specifically an aqueous medium or the like.

Hereinafter, the main components of the transfer type ink jet recording apparatus will be described. Specifically, [1] the transfer body, [2] the support member, [3] the reaction liquid applying device, [4] the ink and transfer promotion liquid applying device, [5] the liquid absorbing device, [6] the pressing member, [7] the recording medium, [8] the recording medium conveying device and [9] the cleaning device will be described.

[1] Transfer Body

The transfer body 101 has a surface layer including a surface on which the intermediate image is formed. Examples of the material constituting the surface layer may include a resin, a ceramic and the like. From the viewpoint of durability, a material having high compressive elastic modulus is preferable. Surface treatment may be performed to improve wettability or the like of the transfer promotion liquid.

It is preferable that the transfer body has a compressive layer which is disposed between the surface layer and the support member and serves to absorb pressure fluctuations. The compressive layer disperses local pressure fluctuations and absorbs a deformation of the surface layer. Therefore, it is possible to maintain good transferability even in the case of high-speed recording by providing the compressive layer. Examples of a material constituting the compressive layer may include an elastic material such as a rubber material. Among those, a rubber material having a porous structure which is formed by blending fillers, such as a foaming agent, hollow fine particles and salt with raw rubber along with a vulcanizing agent and a vulcanization accelerator is preferable. Since the elastic material is compressed with a change in volume of a void part upon the pressure fluctuation, a deformation in directions other than the compression direction is small. Therefore, it is possible to improve the transferability and the durability. Examples of the porous structure may include a continuous void structure in which voids are connected to each other or an independent void structure in which voids are separated from each other.

It is preferable that the transfer body further has an elastic layer between the surface layer and the compressive layer. Examples of configuration of the elastic layer may include a resin material, a ceramic material and the like. Among those, it is preferable to use the elastic materials such as the rubber material because the elastic materials are easily processed and have the small change in elastic modulus with temperature and the excellent transferability.

Each layer (surface layer, elastic layer and compressive layer) configuring the transfer body can be bonded to each other by an adhesive or a double-sided tape. A reinforcing layer having a high compressive elastic modulus may be provided to suppress a transverse elongation at the time of installation in the apparatus to preserve stiffness. As the reinforcing layer, a woven fabric or the like can be used. Among the layers configuring the transfer body, the elastic layer or the compressive layer other than the surface layer can be arbitrarily combined. A size of the transfer body can be freely selected according to a recording speed and a size of an image. A form of the transfer body can be, for example, a sheet form, a roller form, a belt form or an endless web form.

[2] Support Member

The transfer body 101 is supported on the support member 102. The transfer body can be disposed on a support by using, for example, an adhesive or a double-sided tape. The transfer body 101 may be disposed on the support member 102 using an installation member formed of metal, a ceramic, a resin and the like. The support member 102 needs to have a certain degree of structural strength from the viewpoint of conveyance accuracy and durability. Examples of the material of the support member may include metal, ceramic, resin and the like. Among those, it is preferable to use metallic materials such as aluminum. It is possible to reduce inertia during the operation and improve control responsiveness in addition to rigidity withstanding a stress during transferring and dimensional accuracy by using the metallic materials.

[3] Reaction Liquid Applying Device

The recording method of the present invention may include the reaction liquid applying step which applies the reaction liquid to the transfer body before the intermediate image forming step. The reaction liquid reacts with the ink by contacting the ink, and contains a reactant which aggregates components having anionic groups such as a resin and a self-dispersible pigment in ink. After applying the ink, the reaction liquid may be further applied to overlap with at least a part of a region to which the ink is applied.

The transfer type ink jet recording apparatus 100 shown in FIGURE includes a reaction liquid applying device 103 as a reaction liquid applying unit which applies the reaction liquid to the transfer body 101. The reaction liquid applying device 103 is a gravure offset roller which includes a reaction liquid container 103*a* which contains the reaction liquid and reaction liquid applying members 103*b* and 103*c* which apply the reaction liquid in the reaction liquid container 103*a* to the transfer body 101. Examples of the reaction liquid applying device include the gravure offset roller, an ink jet type recording head and the like. Among those, it is preferable to use a roller to apply the reaction liquid to the transfer body.

[4] Ink and Transfer Promotion Liquid Applying Device

The transfer type ink jet recording apparatus 100 shown in the drawing has the ink and transfer promotion liquid applying device 104 as a unit which applies the ink and the transfer promotion liquid to the transfer body 101. It is preferable that an ink jet type recording head is used as the ink applying device to eject and apply the ink. In addition, although the transfer promotion liquid applying unit is not particularly limited, it is preferable to eject and apply the transfer promotion liquid using an ink jet type recording head in the same manner as the ink. Examples of the type of the recording head may include a type in which film boiling is caused in the ink by an electrothermal transducer to form bubbles in order to eject the ink, a type in which the ink is ejected by the electromechanical transducer, a type in which the ink is ejected by static electricity and the like. Among those, the recording head using the electrothermal transducer is preferable because it can record an image at a higher speed and a higher density.

It is preferable that the region in which the transfer promotion liquid is applied to the intermediate transfer body includes at least a region in which the ink is applied. That is, it is preferable that the ink and the transfer promotion liquid are applied to overlap with each other. It goes without saying that the transfer promotion liquid is applied even to the region of the intermediate transfer body in which the ink is not applied. The application amount ratio per unit area in the region in which the ink and the transfer promotion liquid are applied may be set so that the application amount of the ink is 0.1 times or more to 10.0 times or less as the mass ratio with respect to the applied amount of the transfer promotion liquid.

The recording head is a full line head extending in the Y direction, and ejection orifices are arranged in a range covering the width of the image recording region of the recording medium of the available maximum size. The recording head has an ejection orifice surface on which the ejection orifices are open, with the ejection orifice surface disposed on a lower surface (transfer body 101 side) of the recording head. The ejection orifice surface faces the surface of the transfer body 101 with a minute gap (about several millimeters).

The ink and transfer promotion liquid applying device 104 may have a plurality of recording heads to apply inks of respective colors such as cyan, magenta, yellow and black (CMYK) and the transfer promotion liquid to the transfer body 101. For example, when the intermediate image is formed using four kinds of inks of the CMYK and the transfer promotion liquid the ink applying device has four ink heads which ejects five kinds of inks of the CMYK and the transfer promotion liquid. These ink heads are arranged in the X direction.

[5] Liquid Absorbing Device

The liquid absorbing device 105 has a liquid absorbing member 105*a* and a pressing member 105*b* for liquid absorption which presses the liquid absorbing member 105*a* against the intermediate image of the transfer body 101. When the liquid absorbing device 105 is configured by the columnar pressing member 105*b* and the belt-like liquid absorbing member 105*a*, the pressing member 105*b* presses the liquid absorbing member 105*a* against the transfer body 101, thereby absorbing the liquid component from the intermediate image. Further, it is possible to absorb the liquid component from the intermediate image even by pressing a columnar pressing member having a liquid absorbing member attached to an outer circumferential surface thereof against the transfer body. Taking into consideration a space and the like in the recording apparatus, it is preferable that the form of the liquid absorbing member 105*a* is the belt form. The liquid absorbing device 105 having the belt-like liquid absorbing member 105*a* may have an extending member such as an extending roller 105*c* which extends the liquid absorbing member 105*a*.

It is possible to cause the liquid absorbing member 105*a* to absorb the liquid component contained in the intermediate image by bringing the liquid absorbing member 105*a* including the porous layer into contact with the intermediate image by using the pressing member 105*b*. As the method for absorbing a liquid component contained in an intermediate image, the method for bringing a liquid absorbing member into contact with an intermediate image may not only be used, but a method of heating, a method of blowing low-humidity air, a method of reducing pressure and the like may also be used in combination. In addition, these methods may be applied to the intermediate image before and after the liquid component are absorbed.

The liquid absorbing member 105*a* rotates in conjunction with the rotation of the transfer body 101. Therefore, the form of the liquid absorbing member 105*a* is preferably a form capable of repeatedly absorbing a liquid, specifically, an endless belt form, a drum form or the like. The liquid component absorbed into the liquid absorbing member 105*a* including the porous layer can be removed from the liquid absorbing member 105*a* by a method for absorbing a liquid component from a back surface of a porous layer, a method for using a member handling a porous member or the like. After the liquid component is removed, the liquid absorbing member 105*a* is rotated to come into contact with a new intermediate image, thereby efficiently absorbing the liquid component contained in the intermediate image.

[6] Pressing Member

The recording apparatus of the present invention includes the transfer unit which brings the intermediate image into contact with the recording medium to transfer the intermediate image. Specifically, as shown in FIGURE, the intermediate image after the removal of the liquid on the transfer body 101 is transferred onto the recording medium 108 conveyed by the recording medium conveying device 107 by contacting the transfer part 111 by the pressing member 106. It is possible to suppress curling, cockling and the like of the recording medium 108 by transferring the intermediate image onto the recording medium 108 after the removal of the liquid component.

The pressing member 106 preferably has the appropriate structural strength from the viewpoint of the conveyance accuracy and durability of the recording medium 108. Examples of the material of the pressing member 106 may include metal, ceramic, resins and the like. Among those, metals such as aluminum are preferable from the viewpoint of improving the control responsiveness by reducing the inertia during the operation as well as having the rigidity withstanding the stress at the time of the transfer or the dimensional accuracy.

It is preferable that the time (pressing time) taken for the pressing member 106 to press the transfer body 101 at the time of transferring the intermediate image onto the recording medium 108 is 5 milliseconds or more to 100 milliseconds or less. It is possible to suppress the damage to the transfer body 101 as well as making the transfer good by setting the pressing time as described above. The pressing time is the time during which the recording medium 108 and the transfer body 101 come into contact with each other. The pressing time can be calculated by measuring a surface pressure using a pressure distribution system and dividing a conveying direction length of a pressing region by a conveying speed. Specifically, the surface pressure distribution measuring device (trade name "I-SCAN", manufactured by Nitta Corporation) or the like can be used.

It is preferable that the pressure (pressing force) at which the pressing member 106 presses the transfer body 101 is 9.8 N $cm^2$ (1 $kg/cm^2$) or more to 294.2 $N/cm^2$ (30 $kg/cm^2$) or less at the time of transferring the intermediate image onto the recording medium 108. It is possible to suppress the damage to the transfer body 101 as well as making the transfer good by setting the pressing force as described above. The pressing force is a nip pressure of the recording medium 108 and the transfer body 101. The pressing force can be calculated by measuring the surface pressure using the pressure distribution measuring system and dividing weighting in the pressed region by an area. Specifically, the surface pressure distribution measuring device (trade name "I-SCAN", manufactured by Nitta Corporation) or the like can be used.

The temperature when the pressing member 106 presses and transfers the transfer body 101 is preferably a temperature equal to or higher than a glass transition point of the rosin ester resin in the transfer promotion liquid. Among those, the temperature when the transfer body is pressed and transferred is preferably 25° C. or more to 140° C., and more preferably 40° C. or more to 140° C. or less. To control the temperature, the recording apparatus preferably includes a heating unit which heats the intermediate image on the transfer body 101, the transfer body 101 and the recording medium 108. Examples of the form of the pressing member 106 may include forms such as the roller form.

[7] Recording Medium

As the recording medium 108, any known recording medium can be used. Examples of the recording medium may include a long object wound in a roll form, a sheet type cut into a predetermined size and the like. Examples of the constituent materials of the recording medium may include paper such as coated paper and plain paper, films such as plastic and metal, wood board, cardboard and the like.

[8] Recording Medium Conveying Device

The recording medium conveying device 107 which conveys the recording medium 108 conveys the recording medium 108 in a direction of an arrow C. The recording medium conveying device 107 is configured by a recording medium feeding roller 107*a* and a recording medium winding roller 107*b*. The conveying speed of the recording medium 108 is preferably determined in consideration of a speed required in each step.

[9] Cleaning Device

As shown in FIGURE, the recording apparatus of the present invention has a cleaning device which is a cleaning unit for applying an aqueous cleaning liquid to the transfer body 101 to clean the transfer body 101. The cleaning device includes a cleaning member for transfer body 109 which applies a cleaning liquid to the transfer body 101 to clean the transfer body 101. It is possible to suppress the degradation in the image quality by cleaning the transfer body 101 using the cleaning member for transfer body 109. As the cleaning member for transfer body 109, a cleaning member having forms such as a roller and a web can be used. The cleaning device can be provided with a cleaning liquid supplying unit which supplies the cleaning liquid to the cleaning member for transfer body 109.

Further, it is preferable that the cleaning device includes a cleaning liquid removing member 110 which removes the cleaning liquid and residue remaining on the cleaned transfer body 101. It is possible to effectively suppress the degradation in the image quality by removing the cleaning liquid or the like, which remains on the transfer body 101, by the cleaning liquid removing member 110. Examples of the method for removing the cleaning liquid remaining on the transfer body 101 can include blade removal, brush removal, liquid absorption by an absorber and the like. Among those, it is preferable to remove the cleaning liquid remaining on the transfer body 101 by the liquid absorption by the absorber. As the cleaning liquid removing member 110, a porous body or the like used as the liquid absorbing member can be used.

(Ink)

The ink used in the recording method of the present invention is preferably the aqueous ink for the ink jet. Hereinafter, each component used in the ink will be described in detail.

[Alkali Metal Ion]

In the present invention, it is required that the content of an alkali metal ion in the transfer promotion liquid is more than the content of an alkali metal ion in the ink. As long as the relationship is satisfied, the ink may contain or may not contain the alkali metal ion. However, since the aqueous ink for the ink jet contains components having anionic groups such as a coloring material or a dispersing agent thereof, a resin, a pH adjusting agent and the like, the alkali metal as a counter ion of these anionic groups is present in the ink. Therefore, to contain the alkali metal ion in the ink, a component having an alkali metal salt type anionic group can be used.

Examples of the alkali metal ion may include lithium ion, sodium ion, potassium ion and the like. Among those, it is preferable that the ink contains at least the potassium ion. The content (μmol/g) of the alkali metal ion in the ink is preferably 10 μmol/g or more to 200 μmol/g or less and more preferably 30 μmol/g or more to 120 μmol/g or less. Among those, the content of the alkali metal ion is particularly preferably 50 μmol/g or more to 120 μmol/g or less. The content of the alkali metal ion is represented by micromoles per unit mass of the ink.

[Coloring Material]

A pigment or a dye can be used as the coloring material to be contained in the ink. The content (% by mass) of the coloring material in the ink is preferably 0.5% by mass or more to 15.0% by mass or less and more preferably 1.0% by mass or more to 10.0% by mass or less with respect to the total mass of the ink. As the coloring material, the pigment is preferably used.

Specific examples of the pigment may include inorganic pigments such as carbon black and titanium oxide and organic pigments such as azo, phthalocyanine, quinacridone, isoindolinone, imidazolone, diketopyrrolopyrrole and dioxazine.

As the dispersion type of the pigment, a resin-dispersed pigment using a resin as a dispersant, a self-dispersible pigment in which a hydrophilic group is bonded to a surface of a pigment particle and the like can be used. In addition, a resin-bonded pigment in which an organic group containing a resin is chemically bonded to the surface of the pigment particle, a microcapsule pigment in which the surface of the pigment particle is coated with a resin or the like can be used. In the present invention, it is preferable to use a resin-dispersed pigment in which a resin as a dispersant is physically adsorbed to the surface of the pigment particle, rather than the resin-bonded pigment or the microcapsule pigment.

As the resin dispersant for dispersing the pigment in the aqueous medium, it is preferable to use a resin dispersant which can disperse the pigment in the aqueous medium by the action of the anionic group. As the resin dispersant, a resin to be described later, in particular, a water-soluble resin can be used. The content (% by mass) of the pigment in the ink is preferably 0.3 times or more to 10.0 times or less the mass ratio with respect to the content of the resin dispersant.

As the self-dispersible pigment, a pigment in which anionic groups such as a carboxylic acid group, a sulfonic acid group and a phosphonic acid group are directly bonded to the surface of the pigment particle or bonded thereto via another atomic group (—R—) can be used. The anionic group may be either an acid form or a salt form. In the case of the salt form, the anionic group may be either in a state in which the salt is partially dissociated or in a state in which the salt is completely dissociated. When the anionic group is the salt form, examples of the cation which becomes counter ion may include alkali metal cation, ammonium, organic ammonium and the like. Specific examples of another atomic group (—R—) may include a linear or branched alkylene group having 1 to 12 carbon atoms, arylene groups such as a phenylene group and a naphthylene group, a carbonyl group, an imino group, an amide group, a sulfonyl group, an ester group, an ether group and the like. In addition, it may also be a group formed by combining these groups.

A dye having an anionic group is preferably used as a dye. Specific examples of the dye may include dyes such as azo, triphenylmethane, (aza) phthalocyanine, xanthene and anthrapyridone. The coloring material contained in the ink used in the recording method of the present invention is preferably a pigment, more preferably a resin-dispersed pigment.

[Resin]

The ink may contain a resin. The content (% by mass) of the resin in the ink is preferably 0.1% by mass or more to 20.0% by mass or less and more preferably 0.5% by mass or more to 15.0% by mass or less with respect to the total mass of the ink.

The resin can be added to the ink as the resin dispersant or an aid thereof (i) to stabilize the dispersion state of the pigment. In addition, the resin can be added to the ink (ii) to improve various properties of the image to be recorded. As the form of the resin, there may be a block copolymer, a random copolymer, a graft copolymer, a combination thereof and the like. In addition, the resin may be a water-soluble resin which can be dissolved in the aqueous medium, and may also be the resin particle which is disposed in the aqueous medium. The resin particle does not necessarily contain the coloring material.

In the present specification, the "resin is water-soluble" means that when a resin is neutralized with alkali equivalent to the acid value, the resin is present in the aqueous medium in the state in which a particle whose diameter can be measured by a dynamic light scattering method are not formed. It may be determined whether the resin is water-soluble depending on the following method. First, a liquid (resin solid content: 10% by mass), which contains the resin neutralized with the alkali (sodium hydroxide, potassium hydroxide or the like) equivalent to the acid value, is prepared. Next, the prepared liquid is diluted with pure water by 10 times (volume basis) to prepare a sample solution. When the particle diameter of the resin in the sample solution is measured by the dynamic light scattering method, it can be determined that the resin is water-soluble in a case where the particle having a particle diameter are not measured. In this case, the measurement conditions can be as follows, for example.

[Measurement Condition]

SetZero: 30 seconds

Measurement number: Three times

Measurement time: 180 seconds

As a particle size distribution measuring device, a particle size analyzer (for example, trade name "UPA-EX 150" manufactured by Nikkiso Co., Ltd.) or the like by the dynamic light scattering method can be used. It goes without saying that the particle size distribution measuring apparatus to be used, the measurement conditions and the like are not limited thereto.

The acid value of the water-soluble resin is preferably 100 mgKOH/g or more to 250 mgKOH/g or less. The acid value of the resin constituting the resin particle is preferably 5 mgKOH/g or more to 100 mgKOH/g or less. A weight average molecular weight of the water-soluble resin is preferably 3,000 or more to 15,000 or less. A weight average molecular weight of the resin constituting the resin particle is preferably 1,000 or more to 2,000,000 or less. A 50% particle diameter ($D_{50}$) based on the volume distribution of the resin particle measured by the dynamic light scattering method is preferably 50 nm or more to 500 nm or less.

Examples of the resin may include an acrylic resin, a urethane-based resin, an olefin-based resin and the like. Among those, the acrylic resin or the urethane-based resin is preferable, and an acrylic resin composed of units derived from (meth) acrylic acid or (meth) acrylate is more preferable.

As the acrylic resin, a resin which has a hydrophilic unit and a hydrophobic unit as a constitutional unit is preferably used. Among those, a resin having a hydrophilic unit derived from (meth) acrylic acid and a hydrophobic unit derived from at least one of a monomer having an aromatic ring and a (meth) acrylic acid ester based monomer is preferable. In particular, a resin having a hydrophilic unit derived from (meth) acrylic acid and a hydrophobic unit derived from at least one monomer of styrene and α-methylstyrene is preferable. Since these resins easily interact with the pigment, they can be suitably used as a resin dispersant for dispersing the pigment.

The hydrophilic unit is a unit having a hydrophilic group such as an anionic group. The hydrophilic unit can be formed by polymerizing, for example, a hydrophilic monomer having a hydrophilic group. Specific examples of the hydrophilic monomer having the hydrophilic group may include acidic monomers having carboxylic acid groups such as (meth) acrylic acid, itaconic acid, maleic acid and fumaric acid, anionic monomers such as anhydrides and salts of these acidic monomers and the like. Examples of the cation constituting the salt of the acidic monomer may include ions such as lithium, sodium, potassium, ammonium and organic. The hydrophilic unit is a unit which does not have a hydrophilic group such as an anionic group. The hydrophilic unit can be formed by polymerizing, for example, a hydrophilic monomer not having a hydrophilic group such as an anionic group. Specific examples of the hydrophobic monomer may include monomers having aromatic rings such as styrene, α-methylstyrene and benzyl (meth) acrylate, (meth) acrylate ester monomer such as methyl (meth) acrylate, butyl (meth) acrylate and 2-ethylhexyl (meth) acrylate and the like.

The urethane-based resin can be obtained, for example, by reacting polyisocyanate with polyol. In addition, the urethane-based resin can be obtained by the additional reaction of a chain extender. Examples of the olefin-based resin may include polyethylene, polypropylene and the like.

[Aqueous Medium]

The ink used in the recording method of the present invention is aqueous ink containing at least water as the aqueous medium. The ink can contain water or an aqueous medium which is a mixed solvent of water and a water-soluble organic solvent. It is preferable to use deionized water or ion-exchanged water as the water. The content (% by mass) of the water in the aqueous ink is preferably 50.0% by mass or more to 95.0% by mass or less with respect to the total mass of the ink. In addition, the content (% by mass) of the water-soluble organic solvent in the aqueous ink is preferably 3.0% by mass or more to 50.0% by mass or less with respect to the total mass of the ink. As the water-soluble organic solvent, any of alcohols, (poly) alkylene glycols, glycol ethers, nitrogen-containing compounds, sulfur-containing compounds and the like which can be used for the ink for the ink jet can be used.

[Other Additives]

In addition to the above components, if necessary, the ink may contain various additives such as an antifoaming agent, a surfactant, a pH adjusting agent, a viscosity adjusting agent, a rust-preventive agent, an antiseptic agent, a mildewproofing agent, an antioxidant and a reduction inhibitor. However, it is preferable that the ink does not contain the reactant used in the reaction liquid as described later. If contained, the content of the reactant is negligible (the content of about 0.05% by mass or less).

[Physical Properties of Ink]

The above-described ink is the aqueous ink which is applied to the ink jet system. Therefore, from the viewpoint of the reliability, it is preferable to properly control the physical property values. In detail, the surface tension of the ink at 25° C. is preferably 20 mN/m or more to 60 mN/m or less. In addition, the viscosity of the ink at 25° C. is preferably 1.0 mPa·s or more to 10.0 mPa·s or less. The pH of the ink at 25° C. is preferably 7.0 or more to 9.5 or less and more preferably 8.0 or more to 9.5 or less.

(Transfer Promotion Liquid)

The transfer promotion liquid used in the recording method of the present invention is an aqueous liquid, preferably a liquid ejected from the ink jet type recording head. Since it is preferable that the transfer promotion liquid does not affect the image transferred to the recording medium, the transfer promotion liquid may not contain a coloring material. In addition, since the recording method of the present invention may further include the reaction liquid applying step, the transfer promotion liquid does not need to use "reactant" to be contained in the reaction liquid with expectations to have reactivity or "coloring material" to be contained in the ink. Hereinafter, each component used in the transfer promotion liquid will be described in detail.

[Alkali Metal Ion]

As described above, in the present invention, it is required that an content of an alkali metal ion in the transfer promotion liquid is more than an content of an alkali metal ion in the ink. That is, the transfer promotion liquid necessarily contains the alkali metal ions. In order to contain the alkali metal ion in the transfer promotion liquid, a component having an alkali metal salt type anionic group can be used in the same manner as the ink, except that the transfer promotion liquid does not need to contain the coloring material.

Examples of the alkali metal ion may include lithium ion, sodium ion, potassium ion and the like. Among those, it is preferable that the transfer promotion liquid contains at least the potassium ion. The content (μmol/g) of the alkali metal ion in the transfer promotion liquid is preferably 10 μmol/g or more to 200 μmol/g or less and more preferably 50 μmol/g or more to 120 μmol/g or less. If the content of the alkali metal ion is less than 50 μmol/g, the adhesion between the ink layer and the transfer promotion liquid layer is not be increased so much and the transferability may not be sufficiently improved. On the other hand, if the content is more than 120 μmol/g, the concentration of the electrolyte in the system becomes too high and the storage stability of the transfer promotion liquid may not be sufficiently obtained.

[Rosin Particle]

A rosin particle formed by including a rosin ester resin, an anionic emulsifier and a nonionic emulsifier are contained in the transfer promotion liquid. The rosin ester resin is emulsified by the anionic emulsifier and the nonionic emulsifier and is present in the ink in the form of a particle.

The content (% by mass) of the rosin particle in the ink is preferably 1.0% by mass or more to 5.0% by mass or less with respect to the total mass of the transfer promotion liquid. If the content is less than 1.0% by mass, the adhesion between the ink layer and the transfer promotion liquid layer may not be increased so much and the transferability may not be sufficiently improved. On the other hand, if the content is more than 5.0% by mass, since the amount of the rosin particle is increased and thus the flexibility of the transfer promotion liquid layer is increased, the followability of the intermediate image to unevenness of the recording medium is lowered and the transferability may not be sufficiently improved.

The rosin ester resin is a compound obtained by esterifying rosins with alcohols or glycols. Examples of the rosins may include: raw rosins such as gum rosin, wood rosin and tall rosin; disproportionates of these raw rosins; hydrides of these raw rosins; polymerized rosins and the like. Examples of the alcohols may include monohydric alcohols such as methanol, ethanol and isopropanol; dihydric alcohols such as 1,4-butanediol, 1,5-pentanediol and 1,2-hexanediol; trihydric alcohols such as glycerin and trimethylolpropane; polyhydric alcohols more than tetravalence such as pentaerythritol and dipentaerythritol and the like. Among those, polyhydric alcohols of divalence or more are preferable. In addition, examples of the glycols may include (poly) ethylene glycol, (poly) propylene glycol, neopentyl glycol and the like.

Examples of the anionic emulsifier include: an anionic surfactant; and a resin having an anionic group such as an acrylic resin and the like. Examples of the anionic surfactant may include alkylbenzenesulfonic acid salts, polyoxyethylene alkyl ether sulfuric acid ester salts, polyoxyethylene alkyl ether sulfonic acid salts and the like. Examples of the resin having the anionic group may include an acrylic resin having a unit derived from (meth) acrylic acid. Specifically, the resin can be selected from the same acrylic resins described above as those which can be used for the ink. However, considering the function of the emulsifier, a resin having an acid value from 30 to 200 mgKOH/g, a weight average molecular weight from about 1,000 to 10,000 is preferably used.

It is preferable that the proportion (% by mass) of the anionic emulsifier occupied in the rosin particle is preferably 5% by mass or more to 20% by mass or less. If the proportion is less than 5% by mass, the effect of the dispersion stabilization of the rosin particle becomes weak, the storage stability of the transfer promotion liquid cannot be sufficiently obtained, the adhesion between the ink layer and the transfer promotion liquid layer is not increased so much, and the transferability may not be sufficiently improved. On the other hand, if the proportion is more than 20% by mass, the dispersion stabilization of the rosin particle becomes remarkable when the content of the alkali metal ion is particularly large, but the concentration of the electrolyte in the system becomes too high and thus, the storage stability of the transfer promotion liquid may not be sufficiently obtained.

Examples of the nonionic emulsifier may include a compound having an ethylene oxide structure such as a nonionic surfactant and the like. Examples of the nonionic surfactant may include: polyoxyethylene alkyl ether such as polyoxyethylene lauryl ether, polyoxyethylene cetyl ether and polyoxyethylene oleyl ether; an acetylene glycol ethylene oxide adduct and the like. Among those, polyoxyethylene alkyl ether is preferable. As the nonionic surfactant, surfactants having a HLB value of about 5.0 to 10.0 by a Griffin method are preferably used.

The proportion (% by mass) of the nonionic emulsifier occupied in the rosin particle is preferably 5% by mass or more to 20% by mass or less. If the proportion (% by mass) is less than 5% by mass, the effect of the dispersion stabilization of the rosin particle becomes weak and the storage stability of the transfer promotion liquid may not be sufficiently obtained. On the other hand, if the proportion is more than 20% by mass, the aggregation is rather suppressed and the adhesiveness between the ink layer and the transfer promotion liquid layer is not increased so much and the transferability may not be sufficiently improved.

The proportion (% by mass) of the anionic emulsifier occupied in the rosin particle is preferably 0.1 times or more to 10.0 time or less, more preferably 0.3 times or more to 3.0 times or less at the mass ratio with respect to the proportion (% by mass) of the nonionic emulsifier. In addition, the proportion (% by mass) of the total amount of the anionic emulsifier and the nonionic emulsifier occupied in the rosin particle is preferably 20% by mass or more to 70% by mass or less, more preferably 20% by mass or more to 60% by mass or less. Among those, the proportion of the total amount of the anionic emulsifier and the nonionic emulsifier is particularly preferably 30% by mass or more to 50% by mass or less.

The glass transition temperature of the rosin ester resin is preferably 40° C. or less, more preferably 25° C. or less and still more preferably −50° C. or more. The glass transition temperature Tg (° C.) can be measured by a typical method using a thermal analysis apparatus such as differential scanning calorimetry (DSC) in accordance with, for example, JIS K 6240: 2011. In addition, the heating step of heating the intermediate image is performed, and the temperature of the intermediate image at the time of the transfer is preferably the glass transition temperature or more of the rosin ester resin. It is possible to increase the followability to the unevenness of the recording medium and further improve the transferability by transferring the intermediate image heated to the glass transition temperature or more of the rosin ester resin.

The 50% particle diameter ($D_{50}$) based on the volume distribution of the rosin particle measured by a dynamic light scattering method is preferably 50 nm or more to 500 nm or less, and more preferably 200 nm or more to 300 nm or less.

[Other Components]

The transfer promotion liquid may contain various other components as necessary. Specifically, other components can be selected from those the same as the resin, the aqueous medium, other additives and the like described above as those which can be used for the ink. In particular, it is preferable that the transfer promotion liquid contains other resins besides the rosin resin. Specifically, the water-soluble resin, the resin particle and the like as a material as described above as those which can be used in the ink can be used. It is possible to more easily increase the adhesion between the ink layer and the transfer promotion liquid layer and further improve the transferability by the transfer promotion liquid containing the resin.

[Physical Properties of Transfer Promotion Liquid]

The above-described transfer promotion liquid is preferably an aqueous transfer promotion liquid which is applied to the ink jet system. Therefore, from the viewpoint of the reliability, it is preferable to properly control the physical property values. In detail, the surface tension at 25° C. is preferably 20 mN/m or more to 60 mN/m or less. In particular, it is preferable that the surface tension of the transfer promotion liquid is lower than that of the ink. In this case, since the transfer promotion liquid is likely to be diffused on the ink layer, the adhesion between the ink layer and the transfer promotion liquid layer is more likely to be increased and the transferability can be further improved.

In addition, the viscosity of the transfer promotion liquid at 25° C. is preferably 1.0 mPa·s or more to 10.0 mPa·s or less. The pH of the transfer promotion liquid at 25° C. is preferably 7.0 or more to 9.5 or less, and more preferably 8.0 or more to 9.5 or less.

(Reaction Liquid)

The recording method of the present invention may further include the reaction liquid applying step of applying the reaction liquid to the transfer body. It is preferable that the reaction liquid applying step is performed prior to the intermediate image forming step. The reaction liquid reacts with the ink by contacting the aqueous ink to aggregate the components (components having the anionic groups such as the resin and the self-dispersible pigment) in the ink, and is aqueous liquid which contains a reactant. Examples of the reactant may include a polyvalent metal ion, cationic components such as a cationic resin, an organic acid and the like. The components other than the reactant to be contained in the reaction liquid can be selected from those the same as the resins, the aqueous medium, other additives and the like described above as those which can be used in the ink.

EXAMPLES

Hereinafter, the present invention will be described in more detail with reference to Examples, Comparative Examples and Reference Examples, but the present invention is not limited to the following Examples as long as it does not deviate from the gist of the present invention. "part" and "%" regarding a component amount are based on a mass unless otherwise specified.

<Analysis Condition>

Various physical properties were measured under the following conditions in the environment of a temperature of 25° C., a relative humidity of 50% and 1 atmospheric pressure.

(50% Particle Diameter Based on Volume Distribution)

The 50% particle diameter ($D_{50}$) based on the volume distribution was measured by the following method. The ion exchange water was added to a liquid containing a material to be measured to prepare a sample having a solid content of about 1.0%. The particle diameter of the prepared sample was measured under the measurement condition of Set Zero: 30 seconds, measurement number: 3 times, measurement time: 180 seconds and refractive index: 1.5 by using a particle size analyzer (trade name "UPA-EX 150", manufactured by Nikkiso Co., Ltd.) by the dynamic light scattering method. It is determined that the resin whose particle diameter is not measured by the method is the "aqueous" resin.

(Glass Transition Temperature)

The glass transition temperature (Tg) of the resin was measured by using the differential scanning calorimeter (trade name "Q200", manufactured by TA Instruments) for a resin obtained by drying a liquid containing a resin (aqueous dispersion). At this time, the glass transition temperature was measured by performing a cycle, at which the glass transition temperature was measured by increasing a temperature at 10° C./minute from −70° C. to 180° C., twice. However, since the glass transition temperature of the rosin ester resin itself needs to be measured with excluding the influence of the emulsifier contained in the rosin particle, the glass transition temperature of the rosin ester resin before emulsification was measured.

(Content of Alkali Metal Ion)

As the content of the alkali metal ion, the concentrations of lithium, potassium and sodium ion in the sample were measured using an ICP emission spectroscopic analyzer (SPS 5100; manufactured by SII Nanotechnology), respectively.

<Preparation of Resin>

(Resins 1 to 9)

Resins (copolymers) having compositions shown in the following Table 1 were synthesized in the usual manner, neutralized with a neutralizer equivalent to the acid value and added with an appropriate amount of ion exchange water, so aqueous solutions having resins 1 to 9, in which the content of the resin (solid content) is 20.0%, were prepared, respectively. In addition, as each component in the following Table 1, St: styrene, EA: ethyl acrylate, BA: butyl acrylate, AA: acrylic acid are shown.

TABLE 1

Compositions and properties of resins 1 to 9

| Resin | Composition | Neutralizer | Acid value (mgKOH/g) | Weight average molecular weight |
|---|---|---|---|---|
| 1 | St/EA/AA | Potassium hydroxide | 150 | 8000 |
| 2 | St/EA/AA | Lithium hydroxide | 150 | 8000 |
| 3 | St/EA/AA | Sodium hydroxide | 150 | 8000 |

TABLE 1-continued

Compositions and properties of resins 1 to 9

| Resin | Composition | Neutralizer | Acid value (mgKOH/g) | Weight average molecular weight |
|---|---|---|---|---|
| 4 | St/BA/AA | Potassium hydroxide | 150 | 8000 |
| 5 | St/EA/AA | Potassium hydroxide | 120 | 8000 |
| 6 | St/EA/AA | Ammonia water | 150 | 8000 |
| 7 | St/EA/AA | Potassium hydroxide | 130 | 8000 |
| 8 | St/BA/AA | Potassium hydroxide | 130 | 8000 |
| 9 | St/EA/AA | Ammonia water | 130 | 8000 |

(Resin Particle 1)

Into a four-necked flask equipped with a stirrer, a reflux condenser and a nitrogen gas inlet tube, 0.2 part of potassium persulfate and 74.0 parts of ion exchange water were put, and nitrogen gas was introduced thereinto. Also, a mixture was obtained by mixing 18.0 parts of methyl methacrylate, 6.0 parts of butyl methacrylate, 1.0 parts of methacrylic acid and 0.3 parts of an emulsifier (NIKKOL BC 15, manufactured by Nikko Chemicals Co., Ltd.). The obtained mixture was dropped into the four-necked flask under stirring over 1 hour and then reacted at a temperature of 80° C. for 2 hours. Thereafter, the aqueous dispersion liquid (pH 8.5) of the resin particle 2 in which the content of the resin (solid content) is 25.0% was prepared by adding the potassium hydroxide equivalent to the acid value of the resin and the appropriate amount of ion exchange water after the contents were cooled to room temperature. The acid value of the resin particle 1 was 26 mgKOH/g, $D_{50}$ was 220 nm and Tg was 45° C.

(Resin Particle 2)

An aqueous dispersion liquid (pH 8.5) of the resin particle 2 in which the content of the resin (solid content) is 25.0% was prepared in similar procedure as the resin particle 1 except that ammonia water was used instead of the potassium hydroxide. The acid value of the resin particle 2 was 26 mgKOH/g, $D_{50}$ was 220 nm and Tg was 45° C.

<Preparation of Pigment Dispersion Liquid >

(Pigment Dispersion Liquids 1 to 7, 9 and 10)

A mixture was obtained by mixing 10.0 parts of pigment of types shown in the following Table 2, 10.0 parts of an aqueous solution of resin and 80.0 parts of ion exchange water. As carbon black, trade name "Monarch 1100" (manufactured by Cabot Corp.) was used. The obtained mixture and 200 parts of zirconia beads having a diameter of 0.3 mm were put into a batch type vertical sand mill (manufactured by Aimex), dispersed for 5 hours while being cooled with water and centrifuged to remove coarse particles. Pigment dispersion liquids 1 to 7, 9 and 10 were prepared by pressure filtration with a cellulose acetate filter (manufactured by Advantec) having a pore size of 3.0 μm.

(Pigment Dispersion Liquid 8)

A solution in which 5.0 g of concentrated hydrochloric acid was dissolved in 5.5 g of water was cooled to 5° C. and added with 0.91 g of 4-aminophthalic acid in the cooled state. The vessel containing the solution was put into an ice bath and stirred to maintain the temperature of the solution at 10° C. or lower, and was added with a solution obtained by dissolving 1.8 g of sodium nitrite in 9.0 g of ion exchange water at 5° C. After the stirring for 15 minutes, 6.0 g of carbon black (specific surface area of 220 $m^2/g$, DBP oil absorption amount of 105 mL/100 g) was added under the stirring and further stirred for 15 minutes to obtain a slurry. The obtained slurry was filtered by filter paper (trade name "Filter Paper No. 2 for Standard", manufactured by Advantec), particles thereof were sufficiently washed with water, and the slurry was dried in an oven at 110° C. Thereafter, sodium ions were substituted into potassium ions by an ion exchange method to obtain a self-dispersible pigment in which a $—C_6H_3—(COOK)_2$ group was bonded to a particle surface of the carbon black. An appropriate amount of water was added to adjust the content of the pigment, thereby obtaining a pigment dispersion liquid 8 in which the content of the pigment is 10.0%. As a result of measuring a surface charge amount of the self-dispersible pigment in the pigment dispersion liquid 8 by potentiometric titration using an automatic titration device (trade name "AT-510", manufactured by Kyoto Electronics Manufacturing Co., Ltd.) equipped with a flow potential titration unit (PCD-500), the surface charge amount was 0.25 mmol/g. As a titration reagent, 5 mmol/L of methyl glycol chitosan was used.

The preparation conditions and properties of the pigment dispersion liquid are shown in Table 2.

TABLE 2

Preparation conditions and properties of pigment dispersion liquid

| Pigment dispersion liquid | Pigment type | Aqueous solution of resin | Content of pigment (%) | Content of resin (%) |
|---|---|---|---|---|
| 1 | Carbon black | Aqueous solution of resin 1 | 10.0 | 3.0 |
| 2 | Carbon black | Aqueous solution of resin 2 | 10.0 | 3.0 |
| 3 | Carbon black | Aqueous solution of resin 3 | 10.0 | 3.0 |
| 4 | Carbon black | Aqueous solution of resin 4 | 10.0 | 3.0 |
| 5 | C.I. pigment blue 15:3 | Aqueous solution of resin 1 | 10.0 | 3.0 |
| 6 | C.I. pigment red 122 | Aqueous solution of resin 1 | 10.0 | 3.0 |
| 7 | C.I. pigment yellow 74 | Aqueous solution of resin 1 | 10.0 | 3.0 |
| 8 | Carbon black | — | 10.0 | — |
| 9 | Carbon black | Aqueous solution of resin 5 | 10.0 | 3.0 |
| 10 | Carbon black | Aqueous solution of resin 6 | 10.0 | 3.0 |

<Preparation of Aqueous Dispersion Liquid of Rosin Particle>

A mixture of the respective components (unit: part) shown in the upper part of the following Table 3 was irradiated with ultrasonic wave by an ultrasonic irradiator (Trade name "S-150 D Digital Sonifier", manufactured by Branson) while the mixture is heated so that temperature of the mixture is maintained at 90° C. The irradiation time was adjusted based on 1 hour to be within the range of $D_{50}$ to be described later. Thereafter, the mixture was cooled, and the aqueous dispersion liquid of the rosin particle in which the content of the rosin particle (solid content) was 25.0% was prepared. The $D_{50}$ of the prepared rosin particles 1 to 21 were all in the range of 250 nm±10%.

Details of the rosin ester resin shown in the following Table 3 are as follows. Ester gum AT, Super Ester KE-364C, Ester Gum AT and Pensel GA 100 are trade names of rosin ester resin manufactured by Arakawa Chemical Industries, Ltd., and Hariester DS-90 is a trade name of rosin ester resin manufactured by Harima Kasei Co., Ltd.

In addition, each surfactants used as an emulsifier are as follows.

Anionic surfactant 1: sodium dodecylbenzenesulfonate

Nonionic surfactant 1: polyoxyethylene lauryl ether (HLB value by Griffin method 8.3)

Nonionic surfactant 2: polyoxyethylene oleyl ether (HLB value by Griffin method 9.9)

Nonionic surfactant 3: ethylene oxide adduct of acetylene glycol (trade name "Acetylenol E40", manufactured byKawaken Fine Chemicals Co., Ltd., HLB value by Griffin method 8.8).

Properties were shown in the lower part of the following Table 3. The glass transition temperature Tg is a value measured by the above method for the rosin ester resin. The ratio of the rosin ester resin, the anionic emulsifier and the nonionic emulsifier is the value occupied in the rosin particle.

TABLE 3

Preparation conditions and properties of rosin particle

| | | Rosin particle | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Rosin ester resin | Ester gum AT | 70 | 70 | 70 | 70 | 70 | 70 | 82 | 80 | 65 | 60 | 82 |
| | Super ester KE-364C | | | | | | | | | | | |
| | Hariester DS-90 | | | | | | | | | | | |
| | Pensel GA100 | | | | | | | | | | | |
| Anionic emulsifier | Aqueous solution of resin 1 | 75 | | | | 75 | 75 | 15 | 25 | 100 | 125 | 75 |
| | Aqueous solution of resin 2 | | 75 | | | | | | | | | |
| | Aqueous solution of resin 3 | | | 75 | | | | | | | | |
| | Aqueous solution of resin 4 | | | | 75 | | | | | | | |
| | Aqueous solution of resin 6 | | | | | | | | | | | |
| | Anionic surfactant 1 | | | | | | | | | | | |
| Nonionic emulsifier | Nonionic surfactant 1 | 15 | 15 | 15 | 15 | | | 15 | 15 | 15 | 15 | 3 |
| | Nonionic surfactant 2 | | | | | 15 | | | | | | |
| | Nonionic surfactant 3 | | | | | | 15 | | | | | |
| Ion exchange water | | 240 | 240 | 240 | 240 | 240 | 240 | 288 | 280 | 220 | 200 | 240 |
| Properties | Content of rosin particle (%) | 25.0 | 25.0 | 25.0 | 25.0 | 25.0 | 25.0 | 25.0 | 25.0 | 25.0 | 25.0 | 25.0 |
| | Glass transition temperature Tg (° C.) | −24 | −24 | −24 | −24 | −24 | −24 | −24 | −24 | −24 | −24 | −24 |
| | Ratio of rosin ester resin (%) | 70 | 70 | 70 | 70 | 70 | 70 | 82 | 80 | 65 | 60 | 82 |
| | Ratio of anionic emulsifier (%) | 15 | 15 | 15 | 15 | 15 | 15 | 3 | 5 | 20 | 25 | 15 |
| | Ratio of nonionic emulsifier (%) | 15 | 15 | 15 | 15 | 15 | 15 | 15 | 15 | 15 | 15 | 3 |

| | | Rosin particle | | | | | | | | | |
|---|---|---|---|---|---|---|---|---|---|---|---|
| | | 12 | 13 | 14 | 15 | 16 | 17 | 18 | 19 | 20 | 21 |
| Rosin ester resin | Ester gum AT | 80 | 65 | 60 | | | | 80 | 85 | 85 | 70 |
| | Super ester KE-364C | | | | 70 | | | | | | |
| | Hariester DS-90 | | | | | 70 | | | | | |
| | Pensel GA100 | | | | | | 70 | | | | |
| Anionic emulsifier | Aqueous solution of resin 1 | 75 | 75 | 75 | 75 | 75 | 75 | | | 75 | |
| | Aqueous solution of resin 2 | | | | | | | | | | |
| | Aqueous solution of resin 3 | | | | | | | | | | |
| | Aqueous solution of resin 4 | | | | | | | | | | |
| | Aqueous solution of resin 6 | | | | | | | | | | 75 |
| | Anionic surfactant 1 | | | | | | | 5 | | | |
| Nonionic emulsifier | Nonionic surfactant 1 | 5 | 20 | 25 | 15 | 15 | 15 | 15 | 15 | | 15 |
| | Nonionic surfactant 2 | | | | | | | | | | |
| | Nonionic surfactant 3 | | | | | | | | | | |
| Ion exchange water | | 240 | 240 | 240 | 240 | 240 | 240 | 300 | 300 | 240 | 240 |
| Properties | Content of rosin particle (%) | 25.0 | 25.0 | 25.0 | 25.0 | 25.0 | 25.0 | 25.0 | 25.0 | 25.0 | 25.0 |
| | Glass transition temperature Tg (° C.) | −24 | −24 | −24 | −12 | 40 | 58 | −24 | −24 | −24 | −24 |
| | Ratio of rosin ester resin (%) | 80 | 65 | 60 | 70 | 70 | 70 | 80 | 85 | 85 | 70 |
| | Ratio of anionic emulsifier (%) | 15 | 15 | 15 | 15 | 15 | 15 | 5 | 0 | 15 | 15 |
| | Ratio of nonionic emulsifier (%) | 5 | 20 | 25 | 15 | 15 | 15 | 15 | 15 | 0 | 15 |

<Preparation of Ink>

Each component (unit: %) shown in the upper part of the following Table 4 was mixed, sufficiently stirred and was subjected to the pressure filtration with a cellulose acetate filter (manufactured by Advantec) having a pore size of 3.0 μm to prepare each ink. "Acetylenol E100" in the following Table 4 is a trade name of a nonionic surfactant (ethylene oxide adduct of acetylene glycol) manufactured by Kawaken Fine Chemicals Co., Ltd. The lower part of the following Table 4 shows the content (μmol/g) of the alkali metal ion in the ink which was measured by the above-described method. However, the content (μmol/g) of the ammonium ion in the ink, which was measured by an ion meter (trade name "portable ion·pH meter", manufactured by Toa DKK), was shown in the column of the content of alkali metal ion only for ink 13.

TABLE 4

| Composition and properties of ink | | | | | | | | | | | | | | |
|---|---|---|---|---|---|---|---|---|---|---|---|---|---|---|
| | Ink | | | | | | | | | | | | | |
| | 1 | 2 | 3 | 4 | 5 | 6 | 7 | 8 | 9 | 10 | 11 | 12 | 13 | 14 |
| Pigment dispersion liquid 1 | 40.0 | | | | | | | | 40.0 | | | 40.0 | | 40.0 |
| Pigment dispersion liquid 2 | | 40.0 | | | | | | | | | | | | |
| Pigment dispersion liquid 3 | | | 40.0 | | | | | | | | | | | |
| Pigment dispersion liquid 4 | | | | 40.0 | | | | | | | | | | |
| Pigment dispersion liquid 5 | | | | | 40.0 | | | | | | | | | |
| Pigment dispersion liquid 6 | | | | | | 40.0 | | | | | | | | |
| Pigment dispersion liquid 7 | | | | | | | 40.0 | | | | | | | |
| Pigment dispersion liquid 8 | | | | | | | | 40.0 | | | | | | |
| Pigment dispersion liquid 9 | | | | | | | | | | 40.0 | 40.0 | | | |
| Pigment dispersion liquid 10 | | | | | | | | | | | | | 40.0 | |
| Aqueous solution of resin 7 | 5.0 | 5.0 | 5.0 | 5.0 | 5.0 | 5.0 | 5.0 | 7.4 | | 0.5 | 1.2 | 8.0 | | 2.5 |
| Aqueous solution of resin 8 | | | | | | | | | 5.0 | | | | | |
| Aqueous solution of resin 9 | | | | | | | | | | | | | 5.0 | |
| Aqueous dispersion liquid of resin particle 1 | 12.0 | 12.0 | 12.0 | 12.0 | 12.0 | 12.0 | 12.0 | 12.0 | 12.0 | 12.0 | 12.0 | 12.0 | 12.0 | 12.0 |
| Aqueous dispersion liquid of rosin particle 1 | | | | | | | | | | | | | | 12.0 |
| Glycerin | 5.0 | 5.0 | 5.0 | 5.0 | 5.0 | 5.0 | 5.0 | 5.0 | 5.0 | 5.0 | 5.0 | 5.0 | 5.0 | 5.0 |
| Diethylene glycol | 7.0 | 7.0 | 7.0 | 7.0 | 7.0 | 7.0 | 7.0 | 7.0 | 7.0 | 7.0 | 7.0 | 7.0 | 7.0 | 7.0 |
| Acetylenol E100 | 0.5 | 0.5 | 0.5 | 0.5 | 0.5 | 0.5 | 0.5 | 0.5 | 0.5 | 0.5 | 0.5 | 0.5 | 0.5 | 0.5 |
| Ion exchange water | 30.5 | 30.5 | 30.5 | 30.5 | 30.5 | 30.5 | 30.5 | 28.1 | 30.5 | 35.0 | 34.3 | 27.5 | 30.5 | 21.0 |
| Content of alkali metal ion (μmol/g) | 58 | 58 | 58 | 58 | 58 | 58 | 58 | 58 | 58 | 25 | 28 | 72 | 62 | 59 |

<Preparation of Transfer Promotion Liquid>

Each component (unit: %) shown in the upper part of the following Table 5 was mixed, sufficiently stirred and was subjected to pressure filtration with a cellulose acetate filter (manufactured by Advantec) having a pore size of 3.0 μm to prepare each transfer promotion liquid. "Acetylenol E100" in the following Table 5 is a trade name of a nonionic surfactant (ethylene oxide adduct of acetylene glycol) manufactured by Kawaken Fine Chemicals Co., Ltd. The lower part of the following Table 5 shows the content of the alkali metal ion (μmol/g) and the content of the rosin particle (%) in the transfer promotion liquid measured by the above method. However, the content (μmol/g) of the ammonium ion in the ink, which was measured by an ion meter (trade name "portable ion•pH meter", manufactured by Toa DKK), was shown in the column of the content of the alkali metal ion only for transfer promotion liquid 31.

TABLE 5

Composition and properties of transfer promotion liquid

| | Transfer promotion liquid | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| Number of rosin particle | 1 | 2 | 3 | 4 | 5 | 6 | 8 | 8 | 1 | 1 | 1 | 1 | 1 | 1 | 7 | 8 |
| Aqueous dispersion liquid of rosin particle | 12.0 | 12.0 | 12.0 | 12.0 | 12.0 | 12.0 | 12.0 | 12.0 | 12.0 | 12.0 | 3.2 | 4.0 | 20.0 | 24.0 | 12.0 | 12.0 |
| Aqueous solution of resin 7 | 8.0 | 8.0 | 8.0 | 8.0 | 8.0 | 8.0 | 0.2 | 0.7 | 18.2 | 20.0 | 8.0 | 8.0 | 8.0 | 8.0 | 8.0 | 8.0 |
| Aqueous solution of resin 9 | | | | | | | | | | | | | | | | |
| Aqueous dispersion liquid of resin particle 1 | 20.0 | 20.0 | 20.0 | 20.0 | 20.0 | 20.0 | 20.0 | 20.0 | 20.0 | 20.0 | 20.0 | 20.0 | 20.0 | 20.0 | 20.0 | 20.0 |
| Aqueous dispersion liquid of resin particle 2 | | | | | | | | | | | | | | | | |
| Glycerin | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 |
| Diethylene glycol | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 |
| Acetylenol E100 | 1.0 | 1.0 | 1.0 | 1.0 | 1.0 | 1.0 | 1.0 | 1.0 | 1.0 | 1.0 | 1.0 | 1.0 | 1.0 | 1.0 | 1.0 | 1.0 |
| Ion exchange water | 47.0 | 47.0 | 47.0 | 47.0 | 47.0 | 47.0 | 54.8 | 54.3 | 36.8 | 35.0 | 55.8 | 55.0 | 39.0 | 35.0 | 47.0 | 47.0 |
| Content of alkali metal ion (μmol/g) | 72 | 72 | 72 | 72 | 72 | 72 | 28 | 30 | 120 | 128 | 63 | 64 | 80 | 84 | 63 | 64 |
| Content of rosin particle (%) | 3.0 | 3.0 | 3.0 | 3.0 | 3.0 | 3.0 | 3.0 | 3.0 | 3.0 | 3.0 | 0.8 | 1.0 | 5.0 | 6.0 | 3.0 | 3.0 |

| | Transfer promotion liquid | | | | | | | | | | | | | | |
|---|---|---|---|---|---|---|---|---|---|---|---|---|---|---|---|
| | 17 | 18 | 19 | 20 | 21 | 22 | 23 | 24 | 25 | 26 | 27 | 28 | 29 | 30 | 31 |
| Number of rosin particle | 9 | 10 | 11 | 12 | 13 | 14 | 15 | 16 | 17 | 18 | — | 19 | 20 | 1 | 21 |
| Aqueous dispersion liquid of rosin particle | 12.0 | 12.0 | 12.0 | 12.0 | 12.0 | 12.0 | 12.0 | 12.0 | 12.0 | 12.0 | | 12.0 | 12.0 | 12.0 | 12.0 |
| Aqueous solution of resin 7 | 8.0 | 8.0 | 8.0 | 8.0 | 8.0 | 8.0 | 8.0 | 8.0 | 8.0 | 8.0 | 8.0 | 8.0 | 8.0 | 5.0 | |
| Aqueous solution of resin 9 | | | | | | | | | | | | | | | 8.0 |
| Aqueous dispersion liquid of resin particle 1 | 20.0 | 20.0 | 20.0 | 20.0 | 20.0 | 20.0 | 20.0 | 20.0 | 20.0 | 20.0 | 20.0 | 20.0 | 20.0 | 20.0 | |
| Aqueous dispersion liquid of resin particle 2 | | | | | | | | | | | | | | | 20.0 |
| Glycerin | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 |
| Diethylene glycol | 7.0 | 7.0 | 7.0 | 7.0 | 7.0 | 7.0 | 7.0 | 7.0 | 7.0 | 7.0 | 7.0 | 7.0 | 7.0 | 7.0 | 7.0 |
| Acetylenol E100 | 1.0 | 1.0 | 1.0 | 1.0 | 1.0 | 1.0 | 1.0 | 1.0 | 1.0 | 1.0 | 1.0 | 1.0 | 1.0 | 1.0 | 1.0 |
| Ion exchange water | 47.0 | 47.0 | 47.0 | 47.0 | 47.0 | 47.0 | 47.0 | 47.0 | 47.0 | 47.0 | 59.0 | 47.0 | 47.0 | 50.0 | 47.0 |
| Content of alkali metal ion (μmol/g) | 76 | 80 | 72 | 72 | 72 | 72 | 72 | 72 | 72 | 65 | 60 | 60 | 72 | 58 | 72 |
| Content of rosin particle (%) | 3.0 | 3.0 | 3.0 | 3.0 | 3.0 | 3.0 | 3.0 | 3.0 | 3.0 | 3.0 | 0.0 | 3.0 | 3.0 | 3.0 | 3.0 |

<Evaluation>

In the present invention, in the evaluation criteria of each of the following items, "AA", "A" and "B" were defined as the acceptable level, and "C" was defined as an unacceptable level. The evaluation conditions and the evaluation results are shown in the following Table 6.

(Transferability)

The ink and the transfer promotion liquid were the combination shown on the left part of the following Table 6. In the ink and the transfer promotion liquid applying device 104 of the transfer type ink jet recording apparatus 100 having the configuration shown in the drawing, the ink and transfer promotion liquid are charged to the transfer body 101 in the order of the ink and transfer promotion liquid. The configuration of the transfer type ink jet recording apparatus 100 used is as follows. A cylindrical drum formed of an aluminum alloy was used as the support member 102.

As a surface layer member of the transfer body 101, a surface layer member in which a polyethylene terephthalate film having a thickness of 0.5 mm was coated with silicone rubber (trade name "KE 12", manufactured by Shin-Etsu Chemical Co., Ltd.) having rubber hardness (Durometer type A) of 40° at a thickness of 0.2 mm was used. An atmospheric pressure plasma treatment apparatus (trade name "ST-7000", manufactured by Keyence Corporation) performed a plasma surface treatment on the surface layer member under the conditions of treatment distance: 5 mm, plasma mode: high, treatment speed: 100 mm/sec. In addition, the surface of the surface layer member was immersed, for 10 seconds, in the surfactant aqueous solution prepared by being diluted with pure water so that the concentration of the commercially available neutral detergent (sodium alkylbenzenesulfonate) was 3%, and then dried, thereby obtaining the surface layer member of the transfer body 101. The transfer body 101 was fixed to the support member 102 using a double-sided tape. A heater was incorporated in the transfer body 101, and the transfer body was heated to have a temperature shown in the following Table 6, so that the temperature of the intermediate image was adjusted.

The recording head of the type in which the ink and the transfer promotion liquid are ejected by an on-demand system provided with an electrothermal conversion element was used as the ink and transfer promotion liquid applying device 104 to apply the transfer promotion liquid to the region of the transfer body 101 in which the ink is applied. The recording medium 108 was conveyed by driving a recording medium feeding roller 107*a* and a recording medium winding roller 107*b* so that the speed of the recording medium 108 is equal to the moving speed of the transfer body 101. A solid image was recorded by bringing the recording medium 108 coming into contact with the intermediate image between the transfer body 101 and the pressing member 106 to transfer the intermediate image from the transfer body 101 to the recording medium 108. As the recording medium 108, coated paper (trade name "Vannuovo V", manufactured by Daio Paper Products, basis weight: 157 g/m$^2$) was used. The nip pressure between the transfer body 101 and the pressing member 106 was adjusted to 3 kg/cm$^2$.

The intermediate image of 5 cm×5 cm whose recording duty of the ink and the transfer promotion liquid was 20% was formed on the transfer body 101 by using the transfer type ink jet recording apparatus 100 having the above-described configuration. In the transfer type ink jet recording apparatus 100 according to the present embodiment, the recording duty of the image recorded under the condition that one droplet of 3.0 ng dropped to a unit area of 1/1200 inch×1/1200 inch is defined as 100%.

The area of the intermediate image formed on the transfer body and the area of the intermediate image remaining on the transfer body after transfer were each measured by using an optical microscope. Then, the transfer ratio is calculated depending on the following Equation "transfer ratio=[1−(area of intermediate image remaining on transfer body after transfer)/(area of intermediate image formed on transfer body)}]×100(%)" and the transferability was evaluated depending on the evaluation criteria shown below. In Reference Examples 1 and 2, the same evaluation was performed using only the ink, instead of using the transfer promotion liquid.

A: The transfer rate was 70% or more.

B: The transfer rate was 40% or more to less than 70%.

C: The transfer rate was 20% or more to less than 40%.

D: The transfer rate was less than 20%.

(Storage Stability)

After the transfer promotion liquid obtained as described above was put into a sealed container and stored in the environment at a temperature of 60° C. for 1 week, the state of the transfer promotion liquid was visually observed, and the storage stability was evaluated depending on the evaluation criteria shown below. The storage stability of Reference Example 2 was evaluated by the same procedure for Ink 14.

A: The rosin ester resin was not separated.

B: The rosin ester resin was separated slightly but stirred to return to a homogeneous state.

C: The rosin ester resin was separated or the transfer promotion liquid was gelled and did not return to a homogeneous state even if being stirred.

TABLE 6

| Evaluation conditions and evaluation results | | | | | | |
|---|---|---|---|---|---|---|
| | | Evaluation condition | | | Evaluation result | |
| | | Ink | Transfer promotion liquid | Temperature of intermediate image (° C.) | Transferability | Storage stability |
| Examples | 1 | 1 | 1 | 80 | A | A |
| | 2 | 2 | 1 | 80 | A | A |
| | 3 | 3 | 1 | 80 | A | A |
| | 4 | 4 | — | 80 | A | A |
| | 5 | 5 | 1 | 80 | A | A |
| | 6 | 6 | 1 | 80 | A | A |
| | 7 | 7 | 1 | 80 | A | A |
| | 8 | 8 | 1 | 80 | A | A |
| | 9 | 9 | — | 80 | A | A |
| | 10 | 1 | 2 | 80 | A | A |
| | 11 | 1 | 3 | 80 | A | A |
| | 12 | 1 | 4 | 80 | A | A |
| | 13 | 1 | 5 | 80 | A | A |
| | 14 | 1 | 6 | 80 | A | B |
| | 15 | 10 | 7 | 80 | B | A |
| | 16 | 11 | 8 | 80 | A | A |
| | 17 | 1 | 9 | 80 | A | A |
| | 18 | 1 | 10 | 80 | A | B |
| | 19 | 1 | 11 | 80 | B | A |
| | 20 | 1 | 12 | 80 | A | A |

TABLE 6-continued

| Evaluation conditions and evaluation results | | | | | | |
|---|---|---|---|---|---|---|
| | | Evaluation condition | | | Evaluation result | |
| | | Ink | Transfer promotion liquid | Temperature of intermediate image (° C.) | Transferability | Storage stability |
| | 21 | 1 | 13 | 80 | A | A |
| | 22 | 1 | 14 | 80 | B | A |
| | 23 | 1 | 15 | 80 | B | B |
| | 24 | 1 | 16 | 80 | A | A |
| | 25 | 1 | 17 | 80 | A | A |
| | 26 | 1 | 18 | 80 | A | B |
| | 27 | 1 | 19 | 80 | A | B |
| | 28 | 1 | 20 | 80 | A | A |
| | 29 | 1 | 21 | 80 | A | A |
| | 30 | 1 | 22 | 80 | B | A |
| | 31 | 1 | 23 | 80 | A | A |
| | 32 | 1 | 24 | 80 | A | A |
| | 33 | 1 | 25 | 80 | B | A |
| | 34 | 1 | 26 | 80 | B | A |
| | 35 | 1 | 1 | — | B | A |
| | 36 | 1 | 25 | 40 | B | A |
| Comparative Examples | 1 | 1 | 27 | 80 | D | A |
| | 2 | 1 | 28 | 80 | A | C |
| | 3 | 1 | 29 | 80 | A | C |
| | 4 | 1 | 30 | 80 | D | A |
| | 5 | 12 | 30 | 80 | D | A |
| | 6 | 13 | — | 80 | D | B |
| Reference Examples | 1 | 1 | — | 80 | D | — |
| | 2 | 14 | — | 80 | D | (C) |

As a result of comparing the transferability of Example 35 with the transferability of Example 36, Example 36 was better.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-138192, filed Jul. 14, 2017, and Japanese Patent Application No. 2018-113663, filed Jun. 14, 2018, which are hereby incorporated by reference herein in their entirety.

What is claimed is:

1. An ink jet recording method for recording an image on a recording medium using aqueous ink, the method comprising in order:

forming an intermediate image by applying the aqueous ink to a transfer body and then applying an aqueous transfer promotion liquid to a region of the transfer body in which the aqueous ink is applied; and transferring the intermediate image by bringing the intermediate image into contact with the recording medium, wherein the transfer promotion liquid contains a rosin particle formed by containing a rosin ester resin, an anionic emulsifier and a nonionic emulsifier, and the content of an alkali metal ion in the transfer promotion liquid is more than the content of an alkali metal ion in the ink.

2. The ink jet recording method of claim 1, wherein the content (μmol/g) of the alkali metal ion in the transfer promotion liquid is 30 μmol/g or more to 120 μmol/g or less.

3. The ink jet recording method of claim 1, wherein the content (% by mass) of the rosin particle in the transfer promotion liquid is 1.0% by mass or more to 5.0% by mass or less with respect to a total mass of the transfer promotion liquid.

4. The ink jet recording method of claim 1, wherein a ratio (% by mass) of the anionic emulsifier occupied in the rosin particle is 5% by mass or more to 20% by mass or less.

5. The ink jet recording method of claim 1, wherein a ratio (% by mass) of the nonionic emulsifier occupied in the rosin particle is 5% by mass or more to 20% by mass or less.

6. The ink jet recording method of claim 1, wherein a glass transition temperature of the rosin ester resin is 40° C. or less.

7. The ink jet recording method of claim 1, wherein the anionic emulsifier comprises an acrylic resin.

8. The ink jet recording method of claim 1, wherein the nonionic emulsifier comprises a compound having an ethylene oxide structure.

9. The ink jet recording method of claim 1, wherein the transfer promotion liquid further comprises a resin.

10. The ink jet recording method of claim 1, wherein the ink comprises a pigment.

11. The ink jet recording method of claim 1, further comprising:

heating the intermediate image, wherein in the transferring, a temperature of the intermediate image upon transferring the intermediate image by bringing the intermediate image into contact with the recording medium is equal to or higher than a glass transition temperature of the rosin ester resin.

12. An ink jet recording apparatus used to record an image on a recording medium using aqueous ink, comprising:

an ink applying unit which ejects the aqueous ink by an ink jet system and applies the aqueous ink to a transfer body;

a transfer promotion liquid applying unit which forms an intermediate image by applying an aqueous transfer promotion liquid in a region of the transfer body in which the aqueous ink is applied; and a transfer unit which transfers the intermediate image by bringing the intermediate image into contact with the recording medium, wherein the transfer promotion liquid comprises a rosin particle formed by containing a rosin ester resin, an anionic emulsifier and a nonionic emulsifier, and the content of an alkali metal ion in the transfer promotion liquid is more than the content of an alkali metal ion in the ink.

* * * * *